US008864519B2

(12) United States Patent
Wei

(10) Patent No.: US 8,864,519 B2
(45) Date of Patent: Oct. 21, 2014

(54) COAXIAL CABLE CONNECTOR HAVING A COMPRESSION ELEMENT MOVING BACKWARD IN AN AXIAL DIRECTION

(75) Inventor: Kai-Chih Wei, Taipei (TW)

(73) Assignee: Ezconn Corporation, Taipei (TW)

( * ) Notice: Subject to any disclaimer, the term of this patent is extended or adjusted under 35 U.S.C. 154(b) by 20 days.

(21) Appl. No.: 13/472,585

(22) Filed: May 16, 2012

(65) Prior Publication Data

US 2013/0130544 A1 May 23, 2013

Related U.S. Application Data

(63) Continuation-in-part of application No. 13/303,239, filed on Nov. 23, 2011.

(51) Int. Cl.
*H01R 9/05* (2006.01)
*H01R 13/405* (2006.01)

(52) U.S. Cl.
CPC ..... *H01R 9/05* (2013.01); *H01R 13/405* (2013.01)
USPC ..... 439/578

(58) Field of Classification Search
USPC ..... 439/578–585
See application file for complete search history.

(56) References Cited

U.S. PATENT DOCUMENTS

| | | | | |
|---|---|---|---|---|
| 5,997,350 | A * | 12/1999 | Burris et al. | 439/585 |
| 6,929,508 | B1 * | 8/2005 | Holland | 439/579 |
| 7,021,965 | B1 * | 4/2006 | Montena et al. | 439/578 |
| 7,252,546 | B1 * | 8/2007 | Holland | 439/584 |
| 7,255,598 | B2 * | 8/2007 | Montena et al. | 439/578 |
| 7,264,502 | B2 * | 9/2007 | Holland | 439/578 |
| 7,544,094 | B1 | 6/2009 | Paglia | |
| 7,850,487 | B1 * | 12/2010 | Wei | 439/578 |
| 8,137,132 | B2 * | 3/2012 | Lu | 439/578 |
| 8,491,334 | B2 * | 7/2013 | Rodrigues | 439/584 |

* cited by examiner

*Primary Examiner* — Chandrika Prasad
(74) *Attorney, Agent, or Firm* — Min-Lee Teng; Litron Patent & Trademark Office

(57) ABSTRACT

An electrical signal connector for assembly with a coaxial cable includes a locknut defining an abutment flange at the front side, an inner tube fastened to the rear side of the locknut opposite to the abutment flange and defining a bearing surface portion for receiving the coaxial cable, a cylindrical casing fastened to the rear side of the locknut around the inner tube and defining a first deformable body portion and a second deformable body portion, a barrel and a torque sleeve attached to the locknut and the cylindrical casing. The barrel defines a front end edge stopped against an inside stop flange of the torque sleeve which can be moved to force a rear inside bearing surface of the barrel over the first deformable body portion and second deformable body portion of the cylindrical casing, thereby tightening up the engagement between the electrical signal connector and the coaxial cable.

20 Claims, 9 Drawing Sheets

COAXIAL CABLE CONNECTOR HAVING A COMPRESSION ELEMENT MOVING BACKWARD IN AN AXIAL DIRECTION

This application is a Continuation-In-Part of application Ser. No. 13/303,239, filed on Nov. 23, 2011, now pending. The patent application identified above is incorporated here by reference in its entirety to provide continuity of disclosure.

BACKGROUND OF THE INVENTION

1. Field of the Invention

The present invention relates to an electrical signal connector, and more particularly relates to an electrical signal connector consisting of a locknut, an inner tube, a cylindrical casing, a barrel and a torque sleeve, wherein when a coaxial cable is inserted into the inner tube, the torque sleeve can be moved to force a rear inside bearing surface of the barrel over a first deformable body portion and second deformable body portion of the cylindrical casing, thereby tightening up the engagement between the electrical signal connector and the coaxial cable.

2. Description of the Related Art

With the progress of the times and improvement of the people's living standards, electronic and multimedia technologies have been developing rapidly. In consequence, the sale of TV, stereo, audio and video equipment, digital camera, electronic game machine and many other electronic products keeps growing rapidly every year, and people become more and more critical about the quality of the output signal of entertainment and audio-video equipment. To provide high quality signal output, the quality of related signal line and signal connector is as important as the quality of the entertainment and audio-video equipment itself.

In Community Access Television (CATV) or the so-called cable TV, radio frequency TV signal is transmitted through a fiber optic network and optic nodes to a television of a subscriber via a coaxial cable and related electrical signal connectors and a CATV splitter, providing the subscriber with various services, such as radio and television service, digital television service, on-demand entertainment service, high-speed Internet service, and etc. Different designs and sizes of electrical signal connectors and adapters are commercially available for use with different coaxial cables. To fit different signal transmission quality requirements, the braided outer conductor of a coaxial cable can have a standard, tri-shield or quad-shield design. In consequence, the wire diameter and conductor cutting size must be well controlled to fit the connector so that the impedance between the coaxial cable and the connector can be maintained at 75 Ohm. When a coaxial cable is assembled with an electrical signal connector, a crimping tool may be used to crimp the electrical signal connector, tightening up the engagement between the coaxial cable and the electrical signal connector, avoiding signal loss or permeation of rainwater or impurities.

FIGS. 8 and 9 illustrate an electrical signal connector (cable end connector) A fastened to one end of a coaxial cable B. This cable end connector A consists of a locknut A1, an inner tube A2, a plastic cylindrical casing A3 and a metal barrel A4. The inner tube A2 is fastened to one end of the locknut A1. The plastic cylindrical casing A3 is fastened to the same end of the locknut A1 around the inner tube A2. The metal barrel A4 is movably attached to the distal end of the plastic cylindrical casing A3. During installation, the protective plastic covering B5 of the coaxial cable B is properly stripped off, and then the center conductor B1, insulation spacer B2 and wrapping layer (Mylar film or aluminum foil) B3 of the coaxial cable B are inserted into the plastic cylindrical casing A3 and then the inside space A20 of the inner tube A2 with the braided outer conductor B4 and protective plastic covering B5 of the coaxial cable B attached to the periphery of the plastic cylindrical casing A3. Thereafter, a crimping tool is operated to move the metal barrel A4 relative to the plastic cylindrical casing A3, thereby compressing the plastic cylindrical casing A3 to force internal barbed portions A31 of the plastic cylindrical casing A3 into engagement with the braided outer conductor B4 of the coaxial cable B against the protective plastic covering B5 and the periphery of the inner tube A2. According to this design, the metal barrel A4 is movably attached to the distal end of the plastic cylindrical casing A3 with no guide means provided therebetween. When operating a crimping tool to move the metal barrel A4 relative to the cylindrical casing A3 in forcing the internal barbed portions A31 of the plastic cylindrical casing A3 into engagement with the braided outer conductor B4 of the coaxial cable B, the cylindrical casing A3 may be biased, affecting further signal transmission quality or stability.

To avoid biasing of the cylindrical casing A3 during crimping, an extra accessory may be necessary to guide movement of the metal barrel A4. Further, after insertion of the coaxial cable B into the inside space A20 of the inner tube A2, it is necessary to attach the metal barrel A4 to the distal end of the plastic cylindrical casing A3, complicating the procedure. Further, when moving the metal barrel A4 relative to the plastic cylindrical casing A3 to force the internal barbed portions A31 of the plastic cylindrical casing A3 into engagement with the braided outer conductor B4 of the coaxial cable B, the applied pressure may be not evenly distributed to the coaxial cable B, causing displacement of the coaxial cable B relative to the inner tube A2 and the plastic cylindrical casing 3 and affecting further signal transmission quality or stability.

Therefore, it is desirable to provide an electrical signal connector, which eliminates the drawbacks of the aforesaid prior art design.

SUMMARY OF THE INVENTION

The present invention has been accomplished under the circumstances in view. It is therefore the main object of the present invention to provide an electrical signal connector for use with a coaxial cable, which comprises a locknut defining an abutment flange at the front side, an inner tube fastened to the rear side of the locknut opposite to the abutment flange and defining a bearing surface portion for receiving the coaxial cable, a cylindrical casing fastened to the rear side of the locknut around the inner tube and defining a first deformable body portion and a second deformable body portion, a barrel and a torque sleeve attached to the locknut and the cylindrical casing. The barrel defines a front end edge stopped against an inside stop flange of the torque sleeve so that the torque sleeve can be moved to force a rear inside bearing surface of the barrel over the first deformable body portion and second deformable body portion of the cylindrical casing, thereby tightening up the engagement between the electrical signal connector and the coaxial cable. At this time, the hexagonal end hole of the torque sleeve is engaged with the hexagon flange of the locknut, and the abutment flange of the locknut is exposed to the outside of a hexagonal end hole of the torque sleeve for fastening to an external mating connector. Because the barrel and the torque sleeve are sleeved onto the cylindrical casing and disposed between the first deformable body portion of the cylindrical casing and the locknut before crimping, the torque sleeve and the barrel can be moved smoothly relative to the cylindrical casing, avoiding biasing or tilting and ensuring installation accuracy.

Further, the cylindrical casing is made from an elastically deformable plastic material that is inexpensive when compared to a metal material. Further, when forcing the rear inside bearing surface of the barrel and the inside stop flange of the torque sleeve to compress the tapered face in the first deformable body portion of the cylindrical casing, the raised portion and second deformable body portion of the cylindrical casing will also be evenly compressed to deform elastically and to force the braided outer conductor and protective plastic covering of the coaxial cable against the bearing surface portion and barbed portion of the inner tube, causing the barbed portion of the inner tube to engage into the braided outer conductor of the coaxial cable. Thus, the coaxial cable and the electrical signal connector can be firmly secured together. During this installation procedure, the pressure applied to the coaxial cable will not cause any damage to the center conductor of the coaxial cable and can assure positive engagement between the coaxial cable and the electrical signal connector and a high level of signal transmission quality and stability.

DETAILED DESCRIPTION OF THE PREFERRED EMBODIMENT

Figure 1:
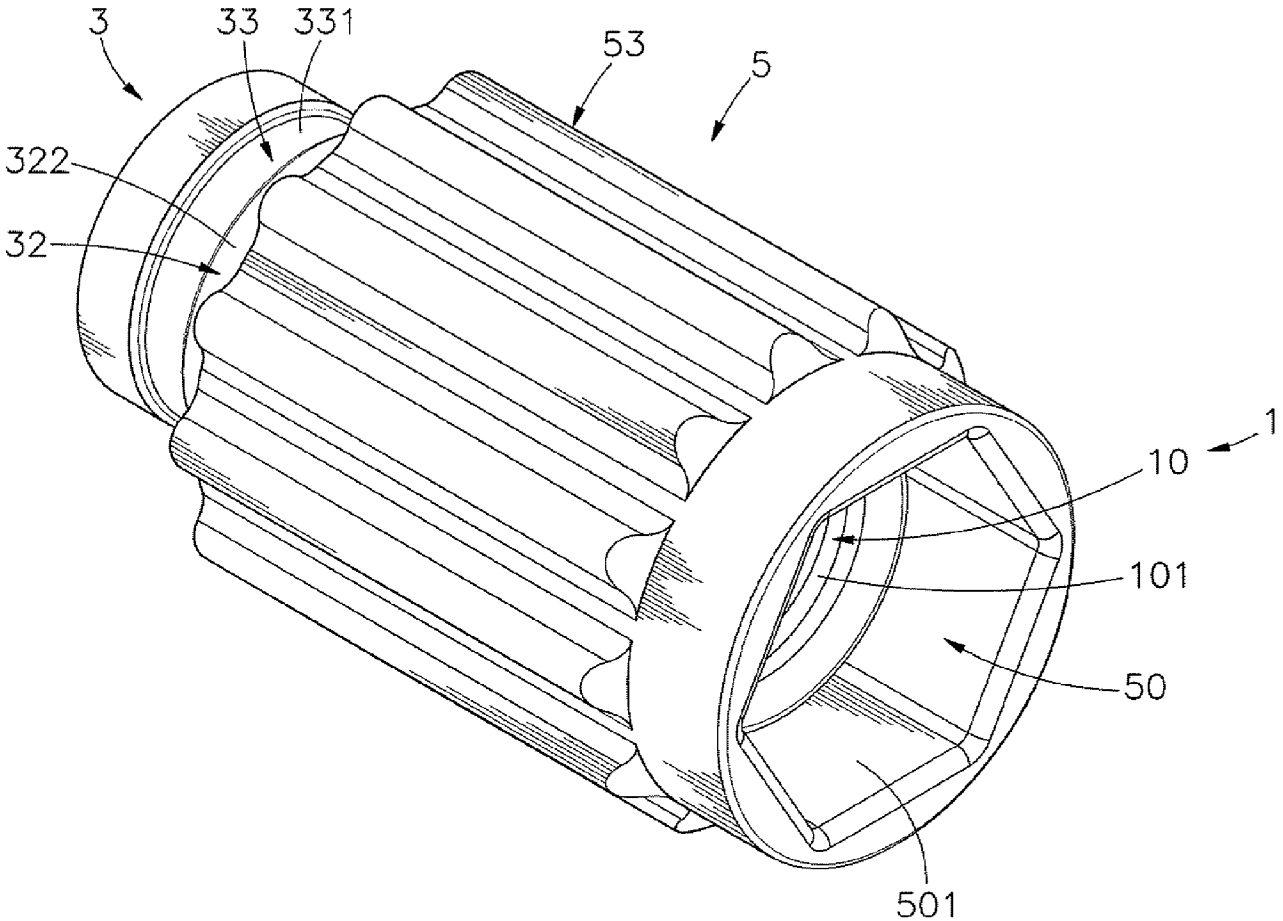
FIG. 1 is an elevational view of an electrical signal connector in accordance with the present invention.
Figure 2:
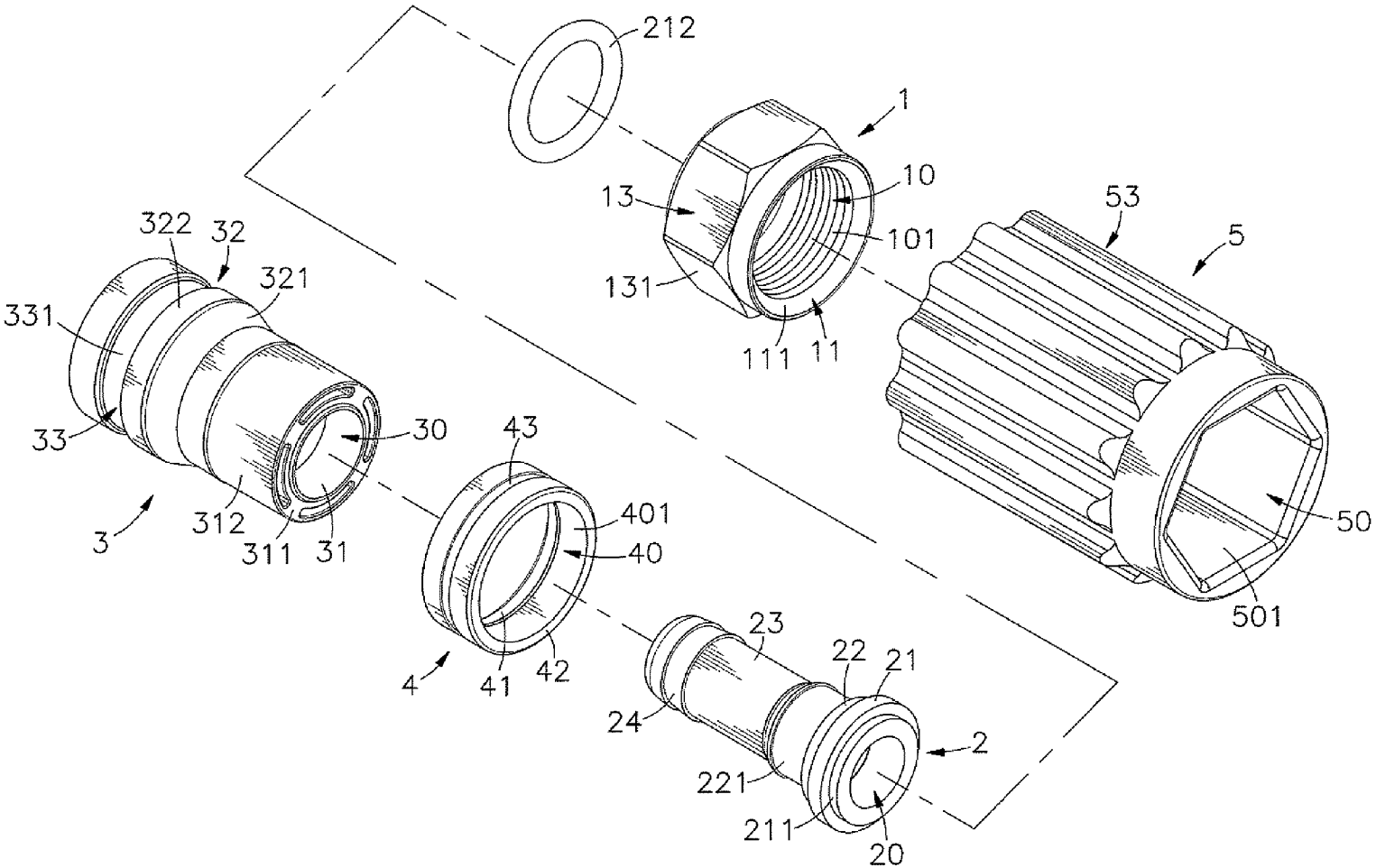
FIG. 2 is an exploded view of the electrical signal connector in accordance with the present invention.
Figure 3:
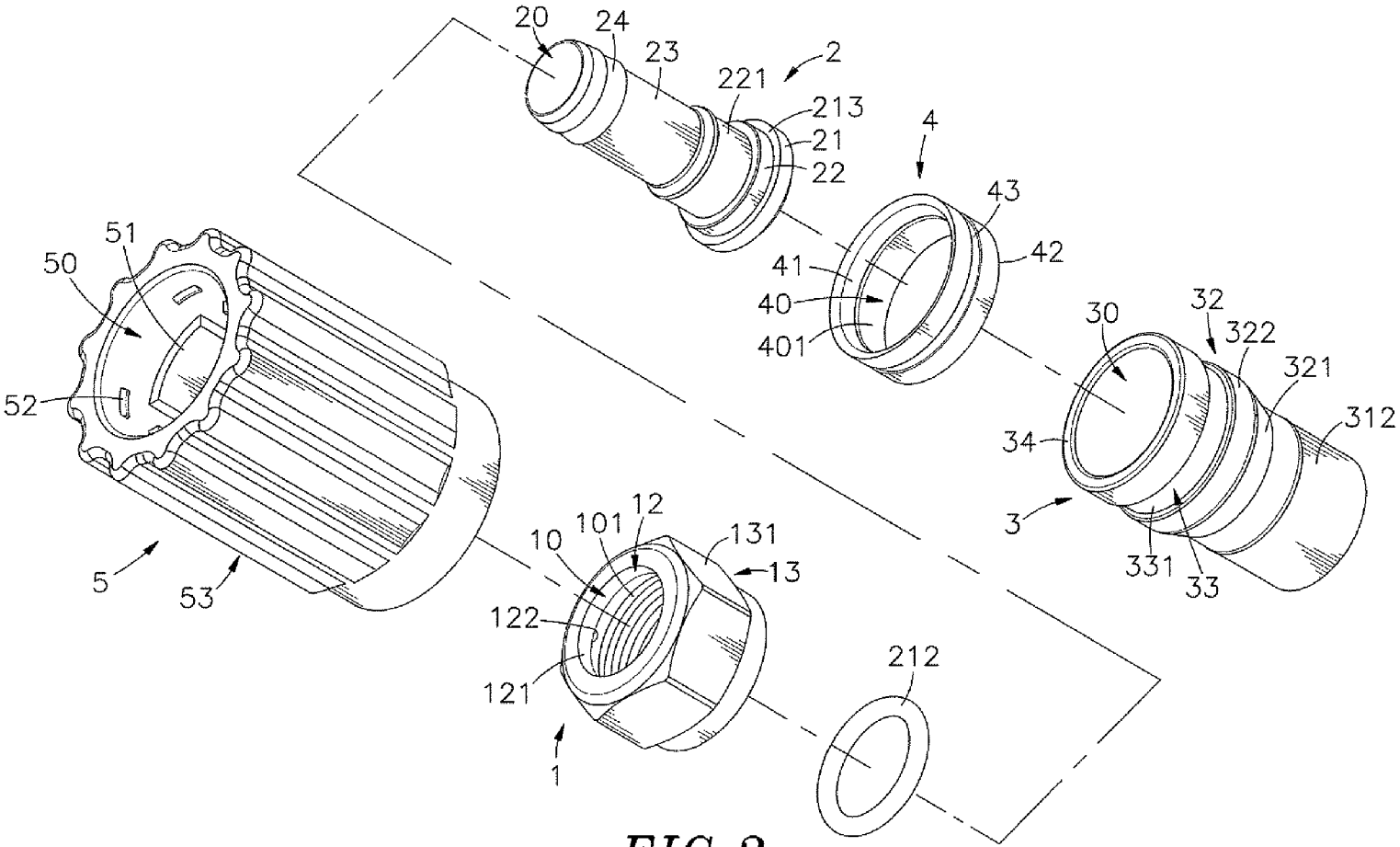
FIG. 3 is another exploded view of the electrical signal connector in accordance with the present invention when viewed from another angle.
Figure 4:
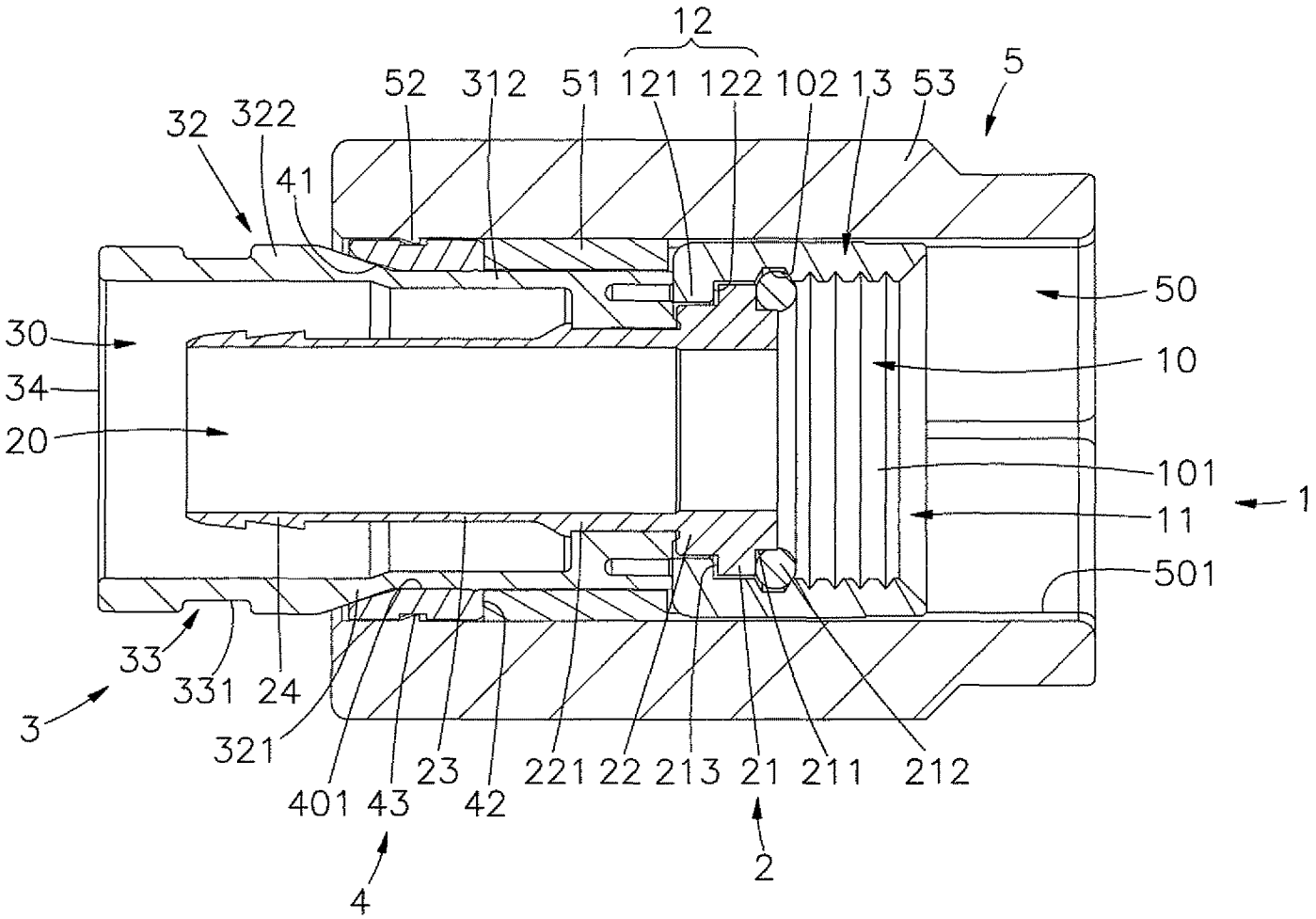
FIG. 4 is a sectional side view of the electrical signal connector in accordance with the present invention.

Referring to FIGS. 1-4, an electrical signal connector in accordance with the present invention is shown comprising a locknut 1, an inner tube 2, a cylindrical casing 3, a barrel 4, and a torque sleeve 5.

The locknut 1 comprises an open chamber 10 extending through opposing front and rear sides thereof, an inner thread 101 and an inside annular groove 102 respectively extending around the inside wall thereof within the open chamber 10, an abutment flange 11 located on the front side, a mating hole 111 surrounded by the abutment flange 11 in communication with one side of the open chamber 10, a retaining flange 12 located on the rear side, a stepped shoulder 121 defined in the retaining flange 12 around an opposite side of the open chamber 10, an annular stop edge 122 defined at the retaining flange 12 at an inner side of the stepped chamber 121, and a tool operable portion 13 extending around the periphery thereof and defining a hexagon flange 131.

The inner tube 2 comprises an axial hole 20 axially extending through opposing front and rear ends thereof, a stop flange 21 extending around the periphery near the front end, a locating groove 211 extending around the periphery at a front side relative to the stop flange 21 for supporting a gasket ring 212, a barbed portion 24 extending around the periphery near the rear end, a coupling portion 22 extending around the periphery at a rear side relative to the stop flange 21, an annular abutment edge 213 radially extending around the periphery between the stop flange 21 and the coupling portion 22, a retaining groove 221 extending around the periphery between the coupling portion 22 and the barbed portion 24, and a bearing surface portion 23 extending around the periphery between the retaining groove 221 and the barbed portion 24.

The cylindrical casing 3 is made from an elastically deformable plastic material comprising a coupling chamber 30 axially extending through opposing front and rear ends thereof, an annular inside flange 31 suspending in one end of the coupling chamber 30, a sliding body portion 312 surrounding the coupling chamber 30, a radial stop wall 311 connected between the annular inside flange 31 and the sliding body portion 312, a first deformable body portion 32 connected to the sliding body portion 312 around the coupling chamber 30, a second deformable body portion 33 disposed at the rear end around the coupling chamber 30 and connected to the first deformable body portion 32 opposite to the sliding body portion 312, a constraint groove 331 extending around the periphery of the second deformable body portion 33, a raised portion 322 formed in the first deformable body portion 32 and extending along one side of the constraint groove 331, a tapered face 321 formed in the first deformable body portion 32 and sloping downwardly from the raised portion 322 toward the sliding body portion 312, and a rear stop edge 34 located on the rear end around the coupling chamber 30.

The barrel 4 comprises a center opening 40, a front end edge 42 disposed at the front side thereof around the center opening 40, a rear inside bearing surface 41 disposed at the rear side thereof around the center opening 40, and a retaining groove 43 extending around the periphery thereof.

The torque sleeve 5 comprises an accommodation chamber 50, a hexagonal end hole 501 defined in a front end thereof in communication with the accommodation chamber 50, at least one inside stop flange 51 extending around the inside wall thereof in the accommodation chamber 50, a plurality of retaining ribs 52 protruded from the inside wall within the accommodation chamber 50 and disposed near a rear end thereof, and an anti-slip portion 53 disposed around the periphery.

When assembling the electrical signal connector, insert the inner tube 2 through the mating hole 111 in the abutment flange 11 of the locknut 1 into the inside of the open chamber 10 to stop the stop flange 21 against the annular stop edge 122 at the retaining flange 12 of the locknut 1 and to force the gasket ring 212 in the locating groove 211 into engagement with the inside annular groove 102 of the locknut 1. The gasket ring 212 is mounted at a front end of the inner tube 2 and in the locknut 1. The stop flange 21, i.e. outer flange, of the inner tube 2 is between the gasket ring 212 and the stepped shoulder 121, i.e. inner flange, of the locknut 1. The inside annular groove 102 around an inner surface of an annular sidewall of the locknut 1 accommodates a radially outer portion of the gasket ring 212. Thus, when the locknut 1 is locked to a mating connector (not shown) of a cable TV (CATV) or closed-circuit TV splitter (not shown), the gasket ring 212 effectively seals out outside rainwater, moisture, or impurities.

Thereafter, insert the inner tube 2 into the coupling chamber 30 of the cylindrical casing 3 to force the retaining groove 221 of the inner tube 2 into engagement with the annular inside flange 31 of the cylindrical casing 3 and to have the retaining flange 12 of the locknut 1 be stopped against the radial stop wall 311 of the cylindrical casing 3. Thus, the retaining flange 12 of the locknut 1 is disposed in the space defined by the annular inside flange 31 of the cylindrical casing 3 and the stop flange 21 of the inner tube 2, preventing falling of the locknut 1 out of the inner tube 2. At this time, the bearing surface portion 23 and barbed portion 24 of the inner tube 2 are suspended in the coupling chamber 30 of the cylindrical casing 3. Thereafter, sleeve the inside wall 401 around the center opening 40 of the barrel 4 onto the sliding body portion 312 of the cylindrical casing 3, and then sleeve the torque sleeve 5 onto the cylindrical casing 3 and the locknut 1 to force the retaining ribs 52 of the torque sleeve 5 into engagement with the retaining groove 43 of the barrel 4, and then push the torque sleeve 5 to force the inside stop flange 51 against the barrel 4, moving the barrel 4 axially along the sliding body portion 312 of the cylindrical casing 3 to the position where the hexagonal end hole 501 of the torque sleeve 5 is engaged with the hexagon flange 131 of the locknut 1.

Figure 5:
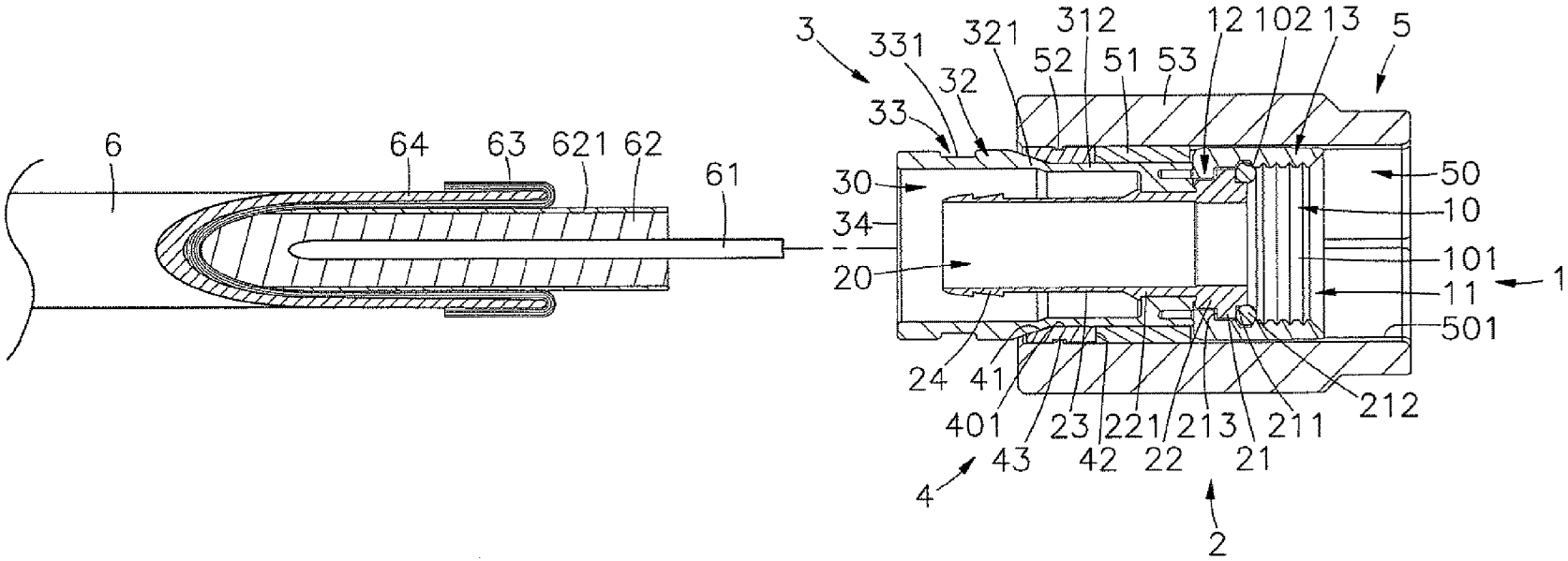
FIG. 5 is a schematic sectional view illustrating the assembly process of the electrical signal connector with a coaxial cable in accordance with the present invention (I).
Figure 6:
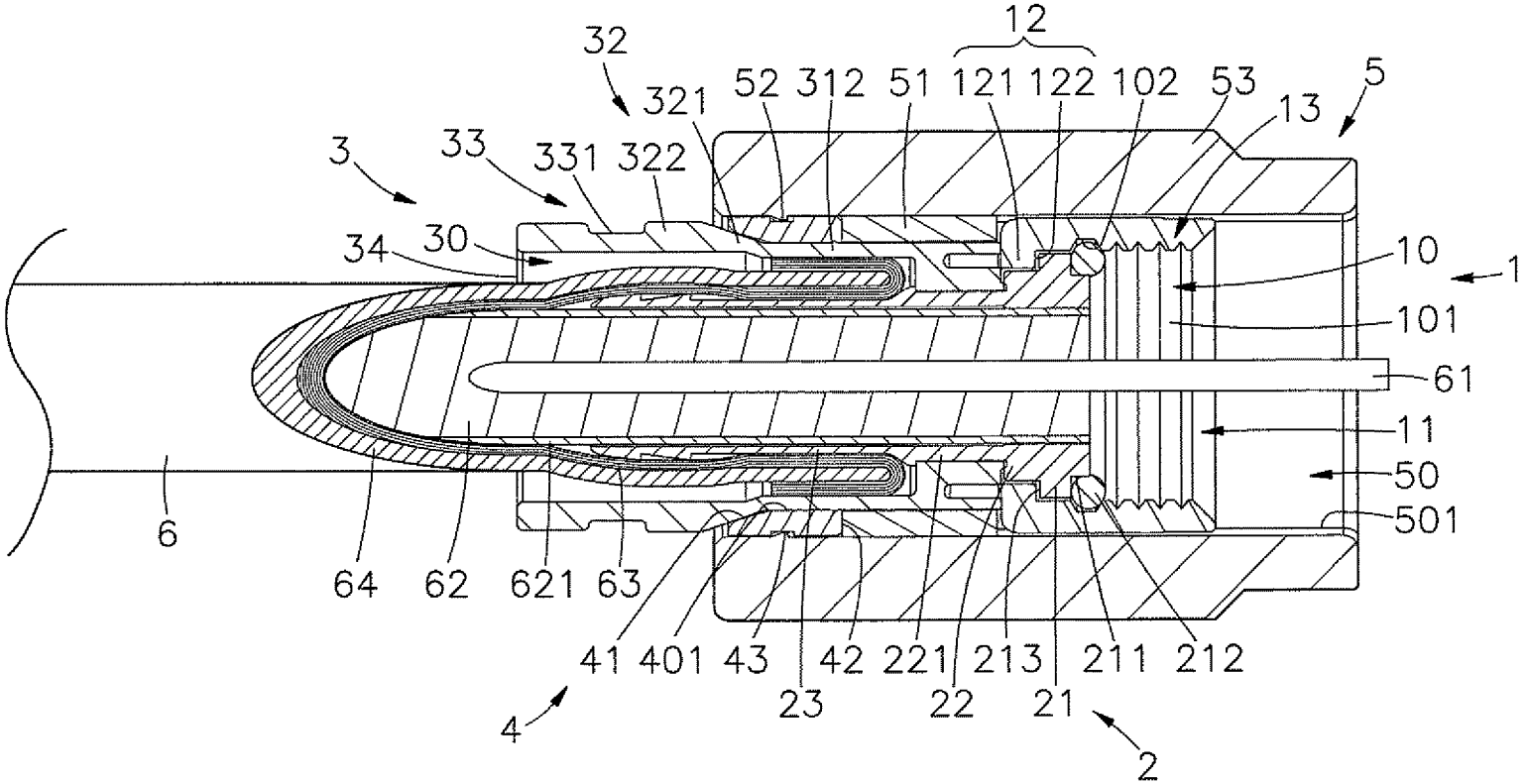
FIG. 6 is a schematic sectional view illustrating the assembly process of the electrical signal connector with a coaxial cable in accordance with the present invention (II).
Figure 7:
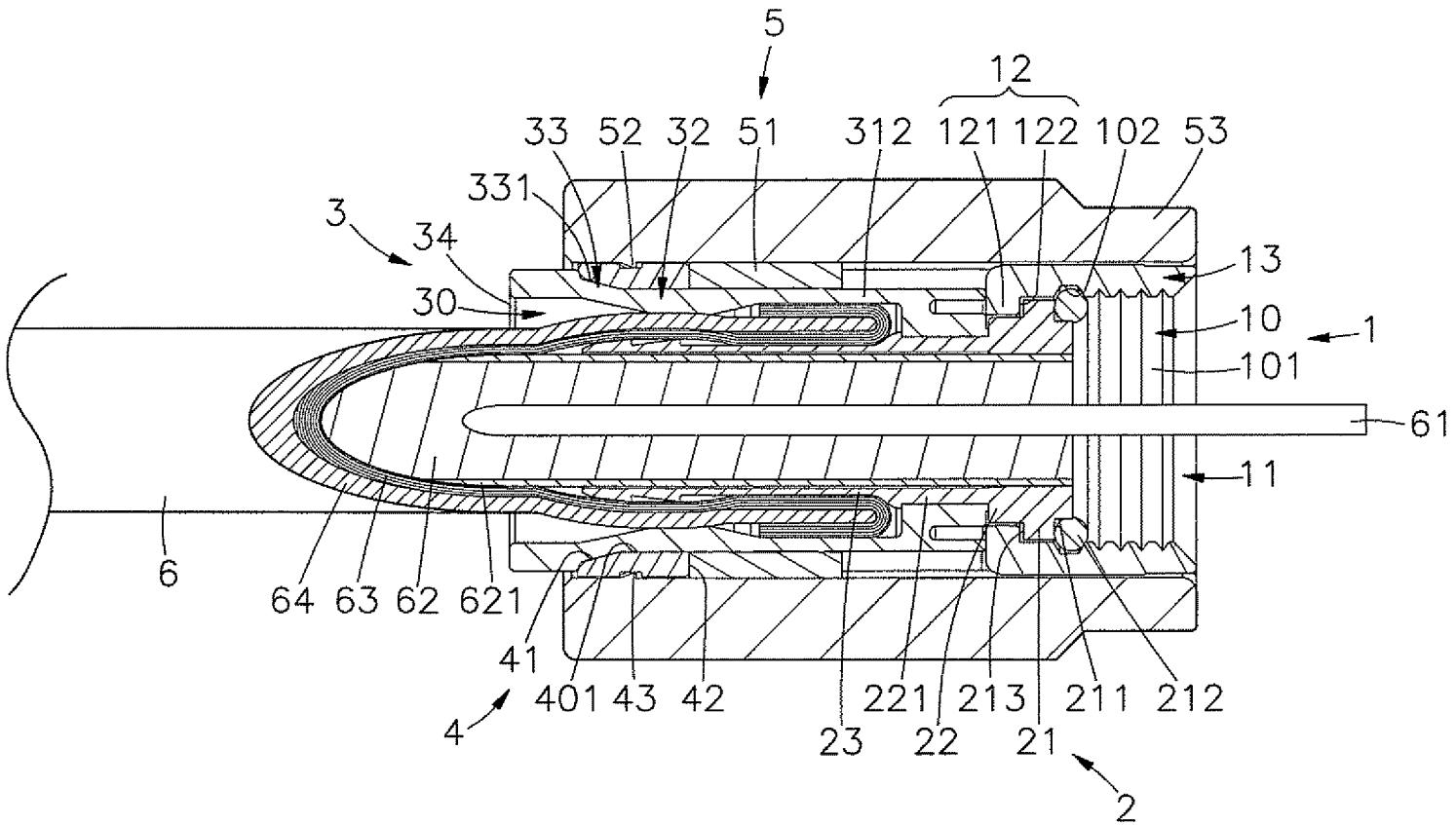
FIG. 7 is a schematic sectional view illustrating the assembly process of the electrical signal connector with a coaxial cable in accordance with the present invention (III).
Figure 8:
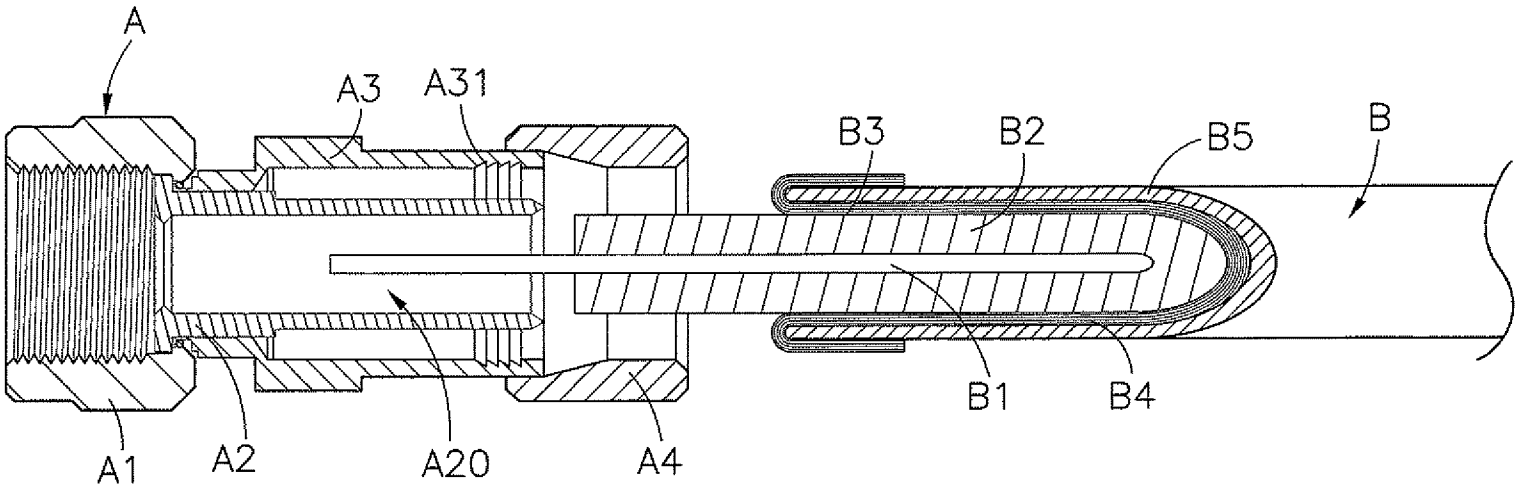
PRIOR ART FIG. 8
FIG. 8 is a sectional side view illustrating the assembly process of an electrical signal connector according to the prior art.
Figure 9:
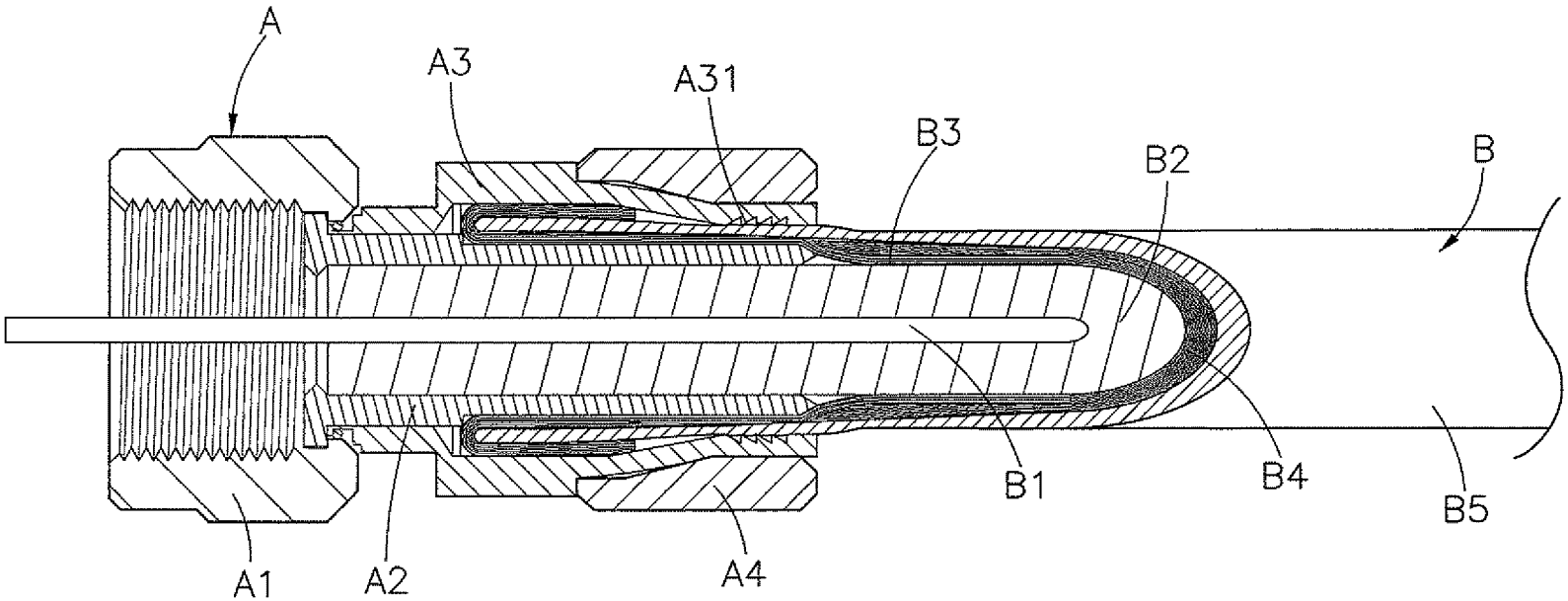
PRIOR ART FIG. 9
FIG. 9 corresponds to FIG. 8, illustrating the electrical signal connector and the coaxial cable assembled.

Referring to FIGS. 5, 6 and 7, the electrical signal connector of the present invention is to be assembled with a coaxial cable 6 comprising a center conductor 61, an insulation spacer 62 surrounding the center conductor 61, a wrapping layer (Mylar film or aluminum foil) 621 surrounding the insulation spacer 62, a braided outer conductor 63 surrounding the wrapping layer 621, and a protective plastic covering 64 surrounding the braided outer conductor 63. During installation, the coaxial cable 6 is manually inserted into the coupling chamber 30 of the cylindrical casing 3 to let the center conductor 61, insulation spacer 62 and wrapping layer (Mylar film or aluminum foil) 621 of the coaxial cable 6 be forced into the axial hole 20 of the inner tube 2 and the braided outer conductor 63 and protective plastic covering 64 of the coaxial cable 6 be attached to the bearing surface portion 23 and barbed portion 24 of the inner tube 2. When reaching the position where the end edge of the insulation spacer 62 of the coaxial cable 6 is kept in flush with the front end of the inner tube 2, the center conductor 61 of the coaxial cable 6 is suspending outside the mating hole 111 of the locknut 1.

Thereafter, a hand tool (for example, wire crimper) or a crimping machine is used to crimp the electrical signal connector against the coaxial cable 6, When a crimping hand tool is used, the two jaws of the crimping hand tool are respectively attached to the annular inside flange 31 of the cylindrical casing 3 and the coaxial cable 6 outside the cylindrical casing 3 with one side edge of one jaw stopped against the rear stop edge 34 of the cylindrical casing 3 and an inner side edge of the other jaw stopped at the outside of the hexagonal end hole 501 of the torque sleeve 5. At this time, the handles of the crimping hand tool are operated to force the two jaws toward each other, moving the torque sleeve 5 relative to the cylindrical casing 3. At this time, the inside stop flange 51 of the torque sleeve 5 is forced to move the barrel 4, i.e. compressing element, toward the first deformable body portion 32 of the cylindrical casing 3, causing the rear inside bearing surface 41 of the barrel 4 and the inside stop flange 51 of the torque sleeve 5 to compress the tapered face 321 in the first deformable body portion 32 of the cylindrical casing 3. Further, the rear inside bearing surface 41 of the barrel 4 can be a tapered surface, curved surface, stepped surface or upright surface, Because the barrel 4 and the torque sleeve 5 are sleeved onto the cylindrical casing 3 and disposed between the first deformable body portion 32 of the cylindrical casing 3 and the locknut 1 before crimping, the torque sleeve 5 and the barrel 4 can be moved smoothly relative to the cylindrical casing 3, avoiding biasing or tilting and ensuring installation accuracy. During installation, no extra accessories are needed. Further, when forcing the rear inside bearing surface 41 of the barrel 4 and the inside stop flange 51 of the torque sleeve 5 to compress the tapered face 321 in the first deformable body portion 32 of the cylindrical casing 3, the raised portion 322 and second deformable body portion 33 of the cylindrical casing 3 will also be evenly compressed to deform elastically and to force the braided outer conductor 63 and protective plastic covering 64 of the coaxial cable 6 against the bearing surface portion 23 and barbed portion 24 of the inner tube 2, causing the barbed portion 24 of the inner tube 2 to engage into the braided outer conductor 63 of the coaxial cable 6. The barrel 4 is sleeved around a portion of the cylindrical casing 3 contacting a region of an outer surface of the protective plastic covering 64, i.e. jacket. Thus, the coaxial cable 6 and the electrical signal connector can be firmly secured together. During this installation procedure, the pressure applied to the coaxial cable 6 will not cause any damage to the center conductor 61 of the coaxial cable 6 and can assure positive engagement between the coaxial cable 6 and the electrical signal connector and a high level of signal transmission quality and stability.

Further, when forcing the torque sleeve 5 to move the barrel 4 during the aforesaid crimping operation, the inside wall 401 of the barrel 4 and the inside stop flange 51 of the torque sleeve 5 will be moved along the sliding body portion 312 of the cylindrical casing 3 to force the first deformable body portion 32 and second deformable body portion 33 of the cylindrical casing 3 into a flush manner, and the rear inside bearing surface 41 of the barrel 4 will be stopped against the constraint groove 331 of the second deformable body portion 33 of the cylindrical casing 3 to prevent falling of the barrel 4 and the torque sleeve 5 from the cylindrical casing 3, assuring connection stability between the coaxial cable 6 and the electrical signal connector. The sleeve 5 includes the inside stop flange 51, i.e. retaining portion, protruding inwardly from an annular sidewall of the sleeve 5. A first radial distance is defined between an innermost point of the inside stop flange 51 and an axis of the sleeve 51. The sleeve 5 includes the retaining ribs 52, i.e. retaining portions, protruding inwardly from the annular sidewall of the sleeve 5. A second radial distance is defined between an innermost point of the retaining ribs 52 and the axis of the sleeve 5. The retaining ribs 52 are closer to a rear end of the annular sidewall of the sleeve 5 than the inside stop flange 51. The barrel 4 includes a radially outer portion arranged closer to the rear end of the annular sidewall of the sleeve 5 than the inside stop flange 51 and farther away from the rear end of the annular sidewall of the sleeve 5 than the retaining ribs 52. A third radial distance between an outermost point of the radially outer portion of the barrel 4 and the axis of the sleeve 5 is greater than the first and second radial distances.

Referring to FIGS. 2 and 5 again, the invention provides an electrical signal connector, which comprises a locknut 1 defining an abutment flange 11 at a front side thereof, an inner tube 2 fastened to a rear side of the locknut 1 opposite to the abutment flange 11 and defining a bearing surface portion 23 for receiving a coaxial cable 6, a cylindrical casing 3 fastened to the rear side of the locknut 1 around the inner tube 2 and defining a first deformable body portion 32 and a second deformable body portion 33, a barrel 4 and a torque sleeve 5 attached to the locknut 1 and the cylindrical casing 3. The barrel 4 comprises a front end edge 42 stopped against an inside stop flange 51 of the torque sleeve 5 so that the torque sleeve 5 can be moved to force a rear inside bearing surface 41 of the barrel 4 over the first deformable body portion 32 and the second deformable body portion 33 of the cylindrical casing 3, thereby tightening up the engagement between the electrical signal connector and the coaxial cable 6. At this time, the hexagonal end hole 501 of the torque sleeve 5 is engaged with the hexagon flange 131 of the locknut 1, and the abutment flange 11 of the locknut 1 is exposed to the outside of a hexagonal end hole 501 of the torque sleeve 5 for fastening to an external mating connector.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A connector configured to be assembled with a coaxial cable comprising a center conductor, an insulation spacer surrounding said center conductor, a braided conductor surrounding said insulation spacer and center conductor, and a jacket surrounding said braided conductor, insulation spacer and center conductor, wherein said braided conductor comprises a folded portion covering a first region of an outer surface of said jacket, comprising:

an inner tube configured to receive said center conductor and insulation spacer of said coaxial cable;

a locknut having a rear portion sleeved around a front portion of said inner tube and configured to receive said center conductor;

a cylindrical casing sleeved around said inner tube, wherein said folded portion of said braided conductor is in a radial gap between said cylindrical casing and said inner tube;

a first ring sleeved around a first portion of said cylindrical casing contacting a second region of said outer surface of said jacket, wherein said first ring is movable along said cylindrical casing in an axial direction; and a sleeve sleeved around said locknut and said first ring.

2. The connector of claim 1, wherein said locknut comprises an inner thread around an inner surface of an annular sidewall of said locknut, wherein said sleeve is sleeved around a hexagon flange of said locknut.

3. The connector of claim 1, wherein said front portion of said inner tube comprises an outer flange contacting an inner flange of said rear portion of said locknut.

4. The connector of claim 3 further comprising a second ring at a front end of said inner tube and in said locknut, wherein said outer flange of said inner tube is between said second ring and said inner flange of said locknut, wherein an annular groove around an inner surface of an annular sidewall of said locknut accommodates a radially outer portion of said second ring.

5. The connector of claim 1, wherein said cylindrical casing comprises an inner flange set to a groove around an outer surface of an annular sidewall of said inner tube.

6. The connector of claim 1, wherein said inner tube comprises a barbed portion at a rear end of said inner tube, wherein said barbed portion is configured to contact said braided conductor of said coaxial cable and surround said insulation spacer of said coaxial cable.

7. The connector of claim 1, wherein said cylindrical casing comprises a second portion having a radially outer dimension greater than that of said first portion and a tapered portion connecting said first portion to said second portion, wherein said first ring has an inner tapered surface outwardly sloped to a rear end of said first ring, wherein said inner tapered surface of said first ring contacts said tapered portion of said cylindrical casing.

8. The connector of claim 1, wherein said first ring abuts against contacts a step of said cylindrical casing.

9. The connector of claim 1, wherein said cylindrical casing comprises a plastic material.

10. The connector of claim 1, wherein said sleeve comprises a first retaining portion inwardly protruding inwardly from an annular sidewall of said sleeve, wherein a first radial distance is defined between an innermost point of said first retaining portion and an axis of said sleeve, and a second retaining portion protruding inwardly from said annular sidewall of said sleeve, wherein a second radial distance is defined between an innermost point of said second retaining portion and said axis of said sleeve, wherein said second retaining portion is closer to a rear end of said annular sidewall of said sleeve than said first retaining portion, wherein said first ring comprises a radially outer portion arranged closer to said rear end of said annular sidewall of said sleeve than said first retaining portion and farther away from said rear end of said annular sidewall of said sleeve than said second retaining portion with a third radial distance between an outermost point of said radially outer portion and said axis of said sleeve being greater than said first and second radial distances.

11. The connector of claim 1, wherein said sleeve comprises a laterally expanding portion outwardly protruding from an outer circular surface of said sleeve.

12. A connector configured to be assembled with a coaxial cable comprising a center conductor and an insulation spacer surrounding said center conductor, comprising:

an inner tube configured to receive said center conductor and insulation spacer of said coaxial cable;

a locknut having a rear portion sleeved around a front portion of said inner tube and configured to receive said center conductor;

a cylindrical casing sleeved around said inner tube; and a compressing element sleeved around said cylindrical casing, wherein said cylindrical casing comprises a first portion that is inwardly deformable by moving said compressing element backwards in an axial direction of said connector.

13. The connector of claim 12, wherein said cylindrical casing further comprises a second portion having a radially outer dimension less than that of said first portion and a tapered portion connecting said first portion to said second portion, wherein said compressing element has an inner tapered surface outwardly sloped to a rear end of said compressing element, wherein said inner tapered surface of said compressing element contacts said tapered portion of said cylindrical casing.

14. The connector of claim 13, wherein said first portion comprises a thick portion and a thin portion having a radial outer dimension less than that of said thick portion, wherein said thick portion is between said thin portion and tapered portion.

15. The connector of claim 14, wherein said cylindrical casing further comprises a third portion having a thickness greater than said thin portion of said cylindrical casing, wherein said radially outer dimension of said thin portion is less than that of said third portion, wherein said thin portion is between said third portion and said thick portion.

16. The connector of claim 12, wherein said inner tube comprises a barbed portion at a rear end of said inner tube, wherein said barbed portion is configured to contact a braided conductor of said coaxial cable and surround said insulation spacer of said coaxial cable.

17. The connector of claim 12, wherein said cylindrical casing comprises a plastic material.

18. The connector of claim 12, wherein said front portion of said inner tube comprises an outer flange contacting an inner flange of said rear portion of said locknut.

19. A sleeve configured to receive a connecting head for a coaxial cable, wherein said sleeve is sleeved around a hexagon flange of a locknut of said connecting head, wherein said locknut has a rear portion sleeved around a front portion of an inner tube of said connecting head, comprising:

a first retaining portion protruding inwardly from an annular sidewall of said sleeve, wherein a first radial distance is defined between an innermost point of said first retaining portion and an axis of said sleeve; and a second retaining portion protruding inwardly from said annular sidewall of said sleeve, wherein a second radial distance is defined between an innermost point of said second retaining portion and said axis of said sleeve, wherein said second retaining portion is closer to a rear end of said annular sidewall of said sleeve than said first retaining portion, wherein said connecting head comprises a radially outer portion configured to be arranged closer to said rear end of said annular sidewall of said sleeve than said first retaining portion and farther away from said rear end of said annular sidewall of said sleeve than said second retaining portion with a third radial distance between an outermost point of said radially outer portion and said axis of said sleeve being greater than said first and second radial distances.

20. The sleeve of claim 19 comprising a laterally expanding portion outwardly protruding from an outer circular surface of said sleeve.

* * * * *